US010593451B2

(12) United States Patent
Masumoto

(10) Patent No.: US 10,593,451 B2
(45) Date of Patent: Mar. 17, 2020

(54) STEEL MATERIAL HAVING EXCELLENT CORROSION RESISTANCE AND EXCELLENT MAGNETIC PROPERTIES AND PRODUCTION METHOD THEREFOR

(71) Applicant: Kobe Steel, Ltd., Kobe-shi (JP)

(72) Inventor: Kei Masumoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 858 days.

(21) Appl. No.: 14/771,319

(22) PCT Filed: Mar. 26, 2014

(86) PCT No.: PCT/JP2014/058451

§ 371 (c)(1),
(2) Date: Aug. 28, 2015

(87) PCT Pub. No.: WO2014/157302

PCT Pub. Date: Oct. 2, 2014

(65) Prior Publication Data

US 2016/0012947 A1 Jan. 14, 2016

(30) Foreign Application Priority Data

Mar. 29, 2013 (JP) ..... 2013-074704

(51) Int. Cl.

| | |
|---|---|
| ***H01F 1/147*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/34*** | (2006.01) |
| ***C22C 38/42*** | (2006.01) |
| ***C23C 8/10*** | (2006.01) |
| ***C22C 38/60*** | (2006.01) |
| ***C21D 8/12*** | (2006.01) |
| ***C21D 1/26*** | (2006.01) |
| ***C21D 6/00*** | (2006.01) |
| ***C22C 38/08*** | (2006.01) |
| ***C22C 38/16*** | (2006.01) |
| ***H01F 41/00*** | (2006.01) |

(52) U.S. Cl.

CPC ..... *H01F 1/14766* (2013.01); *C21D 1/26* (2013.01); *C21D 6/001* (2013.01); *C21D 6/002* (2013.01); *C21D 6/004* (2013.01); *C21D 6/005* (2013.01); *C21D 6/008* (2013.01); *C21D 8/1272* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/08* (2013.01); *C22C 38/16* (2013.01); *C22C 38/20* (2013.01); *C22C 38/34* (2013.01); *C22C 38/42* (2013.01); *C22C 38/60* (2013.01); *C23C 8/10* (2013.01); *H01F 1/147* (2013.01); *H01F 41/00* (2013.01)

(58) Field of Classification Search

None

See application file for complete search history.

(56) References Cited

U.S. PATENT DOCUMENTS

| | | | | |
|---|---|---|---|---|
| 3,522,108 | A * | 7/1970 | Akanuma | C03C 4/00 148/113 |
| 5,019,191 | A * | 5/1991 | Ogata | C21D 8/1222 148/307 |
| 5,352,268 | A * | 10/1994 | Meguro | H01F 1/14733 148/105 |
| 5,372,778 | A | 12/1994 | Yahagi et al. | |
| 5,569,334 | A * | 10/1996 | Kawata | C23C 8/10 148/240 |
| 6,231,690 | B1 * | 5/2001 | Azuma | C23C 8/18 148/287 |
| 2007/0034300 | A1 | 2/2007 | Chiba | |
| 2008/0053580 | A1 | 3/2008 | Drillet et al. | |
| 2009/0047537 | A1 * | 2/2009 | Nanba | C21D 1/70 428/545 |
| 2012/0285585 | A1 | 11/2012 | Nagamatsu et al. | |
| 2013/0272912 | A1 * | 10/2013 | Nakamura | C21D 6/002 420/36 |

FOREIGN PATENT DOCUMENTS

| | | | |
|---|---|---|---|
| JP | 52-24117 A | | 2/1977 |
| JP | 56-15705 | | 4/1981 |
| JP | 57079507 | * | 11/1983 |
| JP | 58197282 | * | 11/1983 |
| JP | 6 228717 | | 8/1994 |
| JP | 2000-87139 A | | 3/2000 |

(Continued)

OTHER PUBLICATIONS

Guthrie, et al. "Steel Processing Technology". ASM Handbook, vol. 1: Properties and Selection. 107-125 (1990) (Year: 1990).*

(Continued)

*Primary Examiner* — Sheng H Davis

(74) *Attorney, Agent, or Firm* — Oblon, McClelland, Maier & Neustadt, L.L.P.

(57) ABSTRACT

The present invention inexpensively provides a steel material having greater corrosion resistance than electromagnetic stainless steel and also having excellent magnetic properties. The steel material comprises, in % by mass, 0.001%-0.025% C, 1.0%-4.0% Si, 0.1%-1.0% Mn, more than 0% but no more than 0.030% P, more than 0% but no more than 0.10% S, more than 0% but less than 4.0% Cr, more than 0% but no more than 0.010% Al, and more than 0% but no more than 0.01% N, with the remainder being iron and unavoidable impurities; and is characterized by having an oxide coating formed on the steel surface material, said oxide coating including either Si or Cr, or both, including a non-crystalline layer, and having a thickness of 50-500 nm.

9 Claims, No Drawings

(56) References Cited

FOREIGN PATENT DOCUMENTS

| | | | | |
|---|---|---|---|---|
| JP | 3324633 | B2 | | 9/2002 |
| JP | 2003 105495 | | | 4/2003 |
| JP | 2007 46125 | | | 2/2007 |
| JP | 2007-239009 | | | 9/2007 |
| JP | 2008 517158 | | | 5/2008 |
| JP | 2010 235976 | | | 10/2010 |
| JP | 2013001998 | | * | 6/2011 |
| JP | 2011 137188 | | | 7/2011 |
| JP | 2011 149089 | | | 8/2011 |
| JP | 2012 153911 | | | 8/2012 |
| KR | 2003-0054427 | A | | 7/2003 |
| WO | 2008082146 | | * | 7/2008 |

OTHER PUBLICATIONS

Extended European Search Report dated Oct. 24, 2016 in Patent Application No. 14774624.2.

International Search Report and Written Opinion of the International Searching Authority dated Jul. 8, 2014 in PCT/JP2014/058451 Filed Mar. 26, 2014.

* cited by examiner

STEEL MATERIAL HAVING EXCELLENT CORROSION RESISTANCE AND EXCELLENT MAGNETIC PROPERTIES AND PRODUCTION METHOD THEREFOR

TECHNICAL FIELD

The present invention relates to a steel material excellent in corrosion resistance and magnetic properties and to a production method therefor.

BACKGROUND ART

In response to the energy saving of automobiles, etc., there is a need for an electromagnetic component to be used in the automobile, etc., in which a magnetic circuit can be controlled more precisely, and energy saving and an improvement in magnetic response speed can be achieved. Accordingly, a steel material to be used as a raw material of the electromagnetic component is required, as magnetic properties, to be easily magnetized by a low external magnetic field and to have small coercive force.

Accordingly, a soft magnetic steel material, the magnetic flux density within which is likely to response to an external magnetic field and which is inexpensive as compared to Ni, Co, or the like, is usually used. Specifically, extremely low carbon steel (pure iron-based soft magnetic material), etc., including, for example, no more than approximately 0.1% by mass C, is used as the soft magnetic steel material. The electromagnetic component (hereinafter, sometimes referred to as a soft magnetic steel component) is typically obtained in the following way: this steel material is subjected to hot rolling, and then to pickling, a lubricating treatment, and wire drawing processing, etc., the last three steps being referred to as secondary processing steps; and a steel wire obtained by the above steps is sequentially subjected to part molding and magnetic annealing, etc.

The aforementioned electromagnetic component is required to have corrosion resistance depending on a usage environment. Electromagnetic stainless steel is used for the part required to have this corrosion resistance. Electromagnetic stainless steel is special steel that combines magnetic properties and corrosion resistance, and applications thereof include: parts utilizing a magnetic circuit in which eddy current suppression is indispensable, such as an injector, sensor, actuator, and motor; electromagnetic components to be used in a corrosive environment; and the like. As the aforementioned electromagnetic stainless steel, 13Cr electromagnetic stainless steel has been used conventionally and often, and for example, Patent Document 1 presents a technique for improving the cold forge ability and the machinability of the 13Cr electromagnetic stainless steel. However, it is more difficult to machine the 13Cr electromagnetic stainless steel than extremely low carbon steel that is more excellent in cold forgeability, and the material price thereof is high because of high contents of an alloy element, which causes the problem that, when an alloy price is steeply increased, the material price is increased in tandem therewith or it becomes difficult to purchase the material. Additionally, for the electromagnetic stainless steel, for example, used in fuel cell vehicles, etc., the improvement in corrosion resistance is recently demanded.

On the other hand, the techniques disclosed, for example, in Patent Documents 2 and 3 are presented as extremely low carbon steel. These techniques are made mainly for the purpose that the strength and the machinability are improved without deteriorating the magnetic properties by controlling steel material components and the dispersion state of sulfide in the steel, and are not studied for the case where corrosion resistance is required.

From the above description, there is a need for an inexpensive steel material having excellent magnetic properties and also having greater corrosion resistance than the aforementioned electromagnetic stainless steel.

CITATION LIST

Patent Literature

[Patent Document 1] Japanese Unexamined Patent Application Publication No. H06 (1994)-228717

[Patent Document 2] Japanese Unexamined Patent Application Publication No. 2010-235976

[Patent Document 3] Japanese Unexamined Patent Application Publication No. 2007-046125

SUMMARY OF INVENTION

Technical Problem

The present invention has been made focusing attention on the aforementioned circumstances, and an object of the invention is to inexpensively achieve a steel material having greater corrosion resistance than electromagnetic stainless steel and also having excellent magnetic properties without adding a large amount of an alloy element.

Solution to Problem

A steel material of the present invention in which the aforementioned problem can be solved, excellent in corrosion resistance and magnetic properties, comprises, in % by mass, 0.001%-0.025% C, 1.0%-4.0% Si, 0.1%-1.0% Mn, more than 0% but no more than 0.030% P, more than 0% but no more than 0.10% S, more than 0% but no more than 4.0% Cr, more than 0% but no more than 0.010% Al, and more than 0% but no more than 0.01% N, with the remainder consisting of iron and unavoidable impurities; and is characterized by having an oxide coating formed on the steel material surface, the oxide coating including either Si or Cr, or both, including a non-crystalline layer, and having a thickness of 50-500 nm.

The steel material may further comprises, as other elements, (a) one or more elements selected from the group consisting of more than 0% but no more than 0.5% Cu and more than 0% but no more than 0.5% Ni; or (b) more than 0% but no more than 1.0% Pb.

The present invention also encompasses a production method of the steel material. The production method is characterized by using steel having the aforementioned chemical composition and by performing annealing under the following conditions:

(Annealing Conditions)

annealing atmosphere: oxygen concentration of no more than 1.0 ppm by volume, annealing temperature: 800° C.-1200° C., and annealing time: no shorter than 1 hour but no longer than 20 hours.

Advantageous Effects of Invention

According to the present invention, a steel material having greater corrosion resistance than electromagnetic stainless steel and also having excellent magnetic properties can be inexpensively provided.

DESCRIPTION OF EMBODIMENTS

The present inventor has intensively studied to inexpensively achieve a steel material having greater and also having excellent magnetic properties without adding a large amount of an alloy element. As a result, it has been found out that the above target properties can be achieved: by controlling the chemical composition of a steel material, in particular, the amounts of Si and Cr as follows; and by forming an oxide coating excellent in corrosion resistance on the steel material surface with the specified annealing, which will be described in detail later, being performed in a production step of the steel material.

Specifically, it has been found out that, when the oxide coating includes either Si or Cr, or both and the steel material includes either Cu or Ni, or both, high corrosion resistance can be achieved by causing the oxide coating to further include either Cu or Ni, or both and by causing the oxide coating to include a non-crystalline layer.

Because the non-crystalline layer has high adhesiveness with the base material and can be formed to be thicker than the passivation film (approximately 5 nm) of stainless steel, high corrosion resistance can be exhibited even in a severe corrosive environment in which corrosion progresses by dissolving a passivation film. In the present invention, the expression of "include a non-crystalline layer" means a state where a halo pattern can be observed in a nano electron beam diffraction image of an oxide coating, as described in the later-described Examples.

The thickness of the oxide coating is determined to be no less than 50 nm in order to achieve greater corrosion resistance than electromagnetic stainless steel. The thickness of the oxide coating is preferably no less than 60 nm, more preferably no less than 70 nm, and still more preferably no less than 80 nm. On the other hand, if the thickness of the oxide coating is too large, a non-crystalline layer is less likely to be formed and crystallization, for example, γ-FeOOH, etc., is formed, and hence it is not preferred. Accordingly, the thickness of the oxide coating is determined to be no more than 500 nm. The thickness thereof is preferably no more than 350 nm, more preferably no more than 300 nm, and still more preferably no more than 200 nm.

In order to form the above specified oxide coating on the steel material surface and to secure properties, such as excellent magnetic properties and high strength required, for example, as a part, a steel material is required to satisfy the following chemical composition. Hereinafter, the chemical composition of the steel material according to the present invention will be described.

[C: 0.001%-0.025%]

C is an element required to secure mechanical strength, and when included in a small amount, C increases electric resistance and can suppress the deterioration in magnetic properties due to an eddy current. However, C dissolves in steel and may distort Fe crystal lattice, and hence if the content thereof is excessively increased, magnetic properties may be greatly deteriorated. Accordingly, the amount of C is determined to be no more than 0.025%. The amount of C is preferably no more than 0.020%, more preferably no more than 0.015%, and still more preferably no more than 0.010%. If the amount of C is less than 0.001%, the effect of improving magnetic properties is saturated, and hence the lower limit of the amount of C is determined to be 0.001% in the present invention.

[Si: 1.0%-4.0%]

Si is an element acting as a deacidification agent when steel is melted. In the present invention, Si is useful for forming the non-crystalline layer in the oxide coating, and is an element that strengthens the oxide coating and further improves corrosion resistance. Si also has the effect of suppressing deterioration in magnetic properties due to an eddy current, by increasing electric resistance. From these viewpoints, the amount of Si is determined to be no less than 1.0%. The amount of Si is preferably no less than 1.4%, and more preferably no less than 1.8%. However, if Si is included in a large amount, the non-crystalline layer is contrarily less likely to be formed and excellent corrosion resistance cannot be secured. Cold forgeability and magnetic properties are also deteriorated. Accordingly, the upper limit of the amount of Si is determined to be 4.0%. The amount of Si is preferably no more than 3.6%, and more preferably no more than 3.0%.

[Mn: 0.1%-1.0%]

Mn is an element effectively acting as a deacidification agent. Mn is also an element that serves as a chip breaker by combining with S and by finely dispersing as MnS precipitation, thereby contributing to an improvement in machinability. In order to effectively exhibit such a benefit, it is necessary to include no less than 0.1% Mn. The amount of Mn is preferably no less than 0.15%, and more preferably no less than 0.20%. However, if the amount of Mn is too large, the number of MnS harmful to magnetic properties is increased, and hence the upper limit of the amount thereof is determined to be 1.0%. The amount of Mn is preferably no more than 0.8%, more preferably no more than 0.70%, and still more preferably no more than 0.50%.

[P: More than 0% but No more than 0.030%]

P (phosphorus) is a harmful element that causes grain boundary segregation in steel and has a negative effect on cold forgeability or magnetic properties. Accordingly, the amount of P is determined to be no more than 0.030%. The amount of P is preferably no more than 0.015%, and more preferably 0.010%.

[S: More than 0% but No more than 0.10%]

S (sulfur) has an action of forming MnS in steel as described above and improving machinability by serving as stress concentration points when stress is loaded during cutting. In order to effectively exhibit such a benefit, it is preferable to include no less than 0.003% S. The amount of S is more preferably no less than 0.01%. However, if the amount of S is too large, the number of MnS harmful to magnetic properties is increased. Also, cold forgeability is greatly deteriorated, and hence the amount of S is determined to be no more than 0.10%. The amount of S is preferably no more than 0.09%, and more preferably no more than 0.050%.

[Cr: More than 0% but No more than 4.0%]

Cr increases the electric resistance of a ferrite phase and is an effective element for reducing the damping time constant of an eddy current. Cr also has an effect of reducing a current density in an active state area in a corrosion reaction, thereby contributing to an improvement in corrosion resistance. Cr is also an element that can be included in an oxide coating, and contributes to a further improvement in corrosion resistance by further strengthening the oxide coating. In order to maximize these effects, it is preferable to include no less than 0.01% Cr. The amount of Cr is more preferably no less than 0.05%. However, if Cr is included in a large amount, magnetic properties are deteriorated. Additionally, a non-crystalline layer is contrarily less likely to be formed in an oxide coating formed by annealing, and the thickness of the oxide coating is also likely to be excessive. Further, alloy cost is increased, and hence a steel material cannot be provided inexpensively. Accordingly, the upper limit of the amount of Cr is determined to be 4.0%. The amount of Cr is preferably no more than 3.6%, more preferably no more than 3.0%, and still more preferably no more than 2.0%.

[Al: More than 0% but No more than 0.010%]

Al is an element to be added as a deacidification agent, and has an effect of reducing impurities with the progress of deacidification, so that magnetic properties are improved. In order to produce this effect, it is preferable to include no less than 0.001% Al, and more preferable to include no less than 0.002% Al. However, Al has a function of combining with solid solution N into AlN and refining crystal grains. Accordingly, if Al is included in an excessive amount, crystal grain boundaries are increased by the crystal refinement, thereby deteriorating magnetic properties. Accordingly, the amount of Al is determined to be no more than 0.010% in the present invention. In order to secure more excellent magnetic properties, it is preferable to include no more than 0.008% Al, and more preferable to include no more than 0.005% Al.

[N: More than 0% but No more than 0.01%]

N (nitrogen) binds with Al to form AlN that harms magnetic properties, as described above, and in addition to that, the excess N not combined with Al, etc., remains in steel as solid solution N that also deteriorates magnetic properties. Accordingly, the amount of N should be as small as possible in any case. In the present invention, the upper limit of the amount of N is determined to be 0.01% in consideration of the actual operation conditions of steel production and at which the harmful effects by the aforementioned N can be suppressed to such a degree that they can be practically disregarded. The amount of N is preferably no more than 0.008%, more preferably no more than 0.0060%, still more preferably no more than 0.0040%, and still more preferably no more than 0.0030%.

The basic components of the steel material according to the present invention are as described above, and the remainder consists of iron and unavoidable impurities. As the unavoidable impurities, contamination of elements brought in depending on the situations of raw materials, materials, and production equipment, etc., is allowed. Additionally, by further including, in addition to the basic components: (a) one or more elements selected from the group consisting of the following amount of Cn and the following amount of Ni, corrosion resistance can be further improved; or (b) the following amount of Pb, machinability can be improved.

Hereinafter, these elements will be described in detail.

[One or more Elements Selected from the Group Consisting of more than 0% but no more than 0.5% Cu and more than 0% but no more than 0.5% Ni]

Cu and Ni are elements that improve corrosion resistance by exerting both an effect of reducing a current density in an active state area in a corrosion reaction and an effect of strengthening an oxide coating. In order to exert these effects, when Cu is included, it is preferable to include no less than 0.01% Cu, and more preferable to include no less than 0.10% Cu; or when Ni is included, it is preferable to include no less than 0.01% Ni, and more preferable to include no less than 0.10% Ni. However, if these elements are included in excessive amounts, alloy cost is increased and hence a steel material cannot be provided inexpensively. Further, magnetic properties are greatly deteriorated by a decrease in magnetic moment. Accordingly, it is preferable to determine the upper limit of each of Cu and Ni to be no more than 0.5%. The upper limit of each of Cu and Ni is preferably no more than 0.35%, more preferably no more than 0.20%, and still more preferably no more than 0.15%.

[Pb: More than 0% but No more than 1.0%]

Pb has an effect of forming Pb particles in steel and improving machinability by serving as stress concentration points when stress is loaded during cutting, similarly to MnS, and also has an effect of lubricating a cutting surface because it dissolves by the heat generated during cutting. Accordingly, Pb is an element suitably used for the applications in which machinability is particularly required, such as an application in which high surface accuracy of a cutting surface should be maintained even in heavy cutting, and an application in which chip treatability should be improved. In order to maximize these effects, it is preferable to include no less than 0.01% Pb, and more preferable to include no less than 0.05% Pb. However, if the amount of Pb is too large, magnetic properties and cold forgeability are greatly deteriorated, and hence it is preferable to include no more than 1.0% Pb. The amount of Pb is more preferably no more than 0.50%, and still more preferably no more than 0.30%.

The steel materials of the present invention include: rod-shaped materials, linear ones, and plate-shaped ones (e.g., rolled materials); and molded materials that are molded into parts, such as, for example, electromagnetic components, with the aforementioned steel materials further being subjected to secondary processing (pickling, formation of a lubricating coating, and wire drawing, as described below) and to part processing (part molding such as, for example, cold forging, cutting, and polished rod processing), the aforementioned steel materials and molded materials being subjected to the following annealing.

[Production Method of Steel Material]

In order to obtain the steel material having the specified oxide coating on the steel material surface according to the present invention, the steel having the aforementioned chemical composition should be subjected to annealing under the following conditions. Accordingly, a production method of the steel to be subjected to the annealing is not particularly limited. When the steel to be subjected to the annealing has a part shape such as an electromagnetic component, the steel to be subjected thereto can be produced, for example, in the following way. That is, steel is melted in accordance with a normal melting method so as to satisfy the aforementioned chemical composition, and then subjected to continuous casting and hot rolling, so that a rolled material is produced. The rolled material obtained by the hot rolling is subjected to secondary processing and part molding, so that the steel to be subjected to the annealing can be obtained. In detail, a method can be cited, in which the rolled material having subjected to the hot rolling is subjected to pickling, and after a lubricating coating is formed, the rolled material is subjected to wire drawing and then to cold forging, so that a part is molded. The part can also be formed by cutting or polished rod processing.

In order to form the specified oxide coating on the steel material surface, it is important to perform annealing under the following conditions (annealing atmosphere, heating temperature and time). Hereinafter, each condition will be described in detail.

<Annealing Atmosphere: Oxygen Concentration is no more than 1.0 ppm by Volume.>

In annealing, an oxide coating including a non-crystalline layer and having a specified thickness can be formed on the steel material surface by severely controlling an oxygen concentration in an annealing atmosphere in addition to the following temperature control. Specifically, an oxygen concentration in an annealing atmosphere is determined to be no more than 1.0 ppm by volume. A specific example of the aforementioned annealing atmosphere includes, for example, an atmosphere of high-purity hydrogen, nitrogen, or the like. Alternatively, an Ar atmosphere having an oxygen concentration of no more than 1.0 ppm by volume, which is produced by using high-purity Ar gas, may be adopted as the aforementioned annealing atmosphere. The oxygen concentration is preferably no more than 0.5 ppm by volume, and more preferably no more than 0.3 ppm by volume. The lower limit of the oxygen concentration is determined to be approximately 0.1 ppm by volume, from the viewpoint of forming an oxide coating.

<Heating Temperature in Annealing (Annealing Temperature): 800° C.-1200° C.>

If annealing temperature is too low, an oxide coating including a non-crystalline layer cannot be formed on the steel material surface. Also, the distortion generated in forging or cutting cannot be removed. Accordingly, annealing temperature is determined to be no lower than 800° C. in the present invention. The annealing temperature is preferably no lower than 850° C. On the other hand, if the annealing temperature is too high, the thickness of an oxide coating becomes excessive, a non-crystalline layer is less likely to be formed, and corrosion resistance is deteriorated, and hence it is not preferred. In such a case, mass productivity is further deteriorated due to a rise in power cost, a decrease in furnace wall durability, or the like. Accordingly, the annealing temperature is determined to be no higher than 1200° C. The annealing temperature is preferably no higher than 1100° C., and more preferably no higher than 1000° C.

<Heating Time in Annealing (Annealing Time): no Shorter than 1 Hour but no Longer than 20 Hours>

If annealing time is too short, annealing becomes insufficient even if annealing temperature is set to be higher, and hence an oxide coating cannot be formed uniformly. Accordingly, the annealing time is determined to be no shorter than 1 hour. The annealing time is preferably no shorter than 2 hours. However, if the annealing time is too long, the thickness of an oxide coating becomes too large and productivity is deteriorated, and hence the annealing time is determined to be no longer than 20 hours. The annealing time is preferably no longer than 10 hours.

If a cooling rate is too large in the cooling after the annealing, magnetic properties are deteriorated due to the distortion generated during the cooling. Accordingly, it is preferable to determine the average cooling rate between after the annealing and 300° C. to be no more than 200° C./Hr (time). The average cooling rate is preferably no more than 150° C./Hr. On the other hand, if the average cooling rate in the aforementioned temperature region is too small, productivity is greatly hampered, and hence it is preferable to cool at a rate of no less than 50° C./Hr.

The present application claims priority based on Japanese Patent Application No. 2013-074704, filed on Mar. 29, 2013. The entire disclosure of Japanese Patent Application No. 2013-074704, filed on Mar. 29, 2013, is incorporated herein by reference.

EXAMPLES

Hereinafter, the present invention will be described more specifically with reference to examples, but the invention should not be limited by the following Examples, and of course the invention can also be practiced by adding modifications within a range in which each of the modifications suits the intents before and after thereof, which can be encompassed by the scope of the invention.

After steel having the chemical composition shown in Table 1 (remainder consists of iron and unavoidable impurities) was melted in accordance with a normal melting method, and then subjected to continuous casting and hot rolling, thereby obtaining a rolled material having a diameter of 20 mm. Subsequently, after the rolled material was subjected to pickling under mass production conditions, a lubricating coating was attached, and the rolled material was then subjected to polished rod processing and cutting, thereby obtaining a polished rod cut product having a diameter of 16 mm. Also, a cylindrical test piece (cut test piece) having a size of 10 mm in diameter×10 mm in length was produced by simulated cutting process as a part manufacturing method different from the polished rod processing, that is, by using a lathe. Annealing was performed, under the conditions shown in Table 2, on the aforementioned polished rod cut product or cut test piece thus produced. The average cooling rate between after the annealing and 300° C. was set to be within a range of 100-150° C./Hr.

Oxide coating structure and corrosion resistance were evaluated by using the polished rod cut product or the cut test piece. Also, magnetic properties were evaluated by using the aforementioned rolled material and by producing a test piece for evaluation as described below. In order to examine an influence of presence/absence of the oxide coating on corrosion resistance, corrosion resistance was evaluated by using a test piece having a size of 8 mm in diameter×8 mm in length, the surface layer of which formed after the annealing, namely, the oxide coating of which was removed by being subjected to cutting with the use of a lathe, in Experiments Nos. H03 and H07 in Table 2.

[Evaluation of Oxide Coating]

The oxide coating after the annealing was analyzed by TEM (Transmission Electron Microscope)-FIB (Focused Ion Beam) observation. A sample for TEM observation was produced as follows. That is, the cut test piece after the annealing was subjected to FIB processing by using an FIB processing observation instrument FB 2000A made by Hitachi, Ltd., and by using Ga as an ion source. In order to protect the outermost surface of the sample, a small sample piece was extracted by an FIB micro-sampling method after a carbon film was coated by using a high-vacuum deposition apparatus and an FIB device. Extraction of the sample was performed from a salient in the concavities and convexities produced by the cutting, etc., with the use of a lathe. Thereafter, the extracted small piece was microtomed to the thickness at which TEM observation can be performed with the small piece being subjected to FIB processing in $W(CO)_6$ gas and with being attached to an Mo mesh by depositing W.

TEM observation was performed as follows by using a sample for TEM observation that was thus obtained. That is, TEM observation was performed by using a field emission transmission electron microscope HF-2000 made by Hitachi, Ltd., and under the conditions of a beam diameter of 10 nm and a magnification of 10,000-750,000 times; and the composition of the oxide coating was identified and light field images were taken by using EDX (Energy Dispersive X-ray spectrometry) analysis with the use of an EDX analyzer (Sigma made by KEVEX Corp.) The presence/absence of Si or Cr in the oxide coating (when the steel material included either Cu or Ni, or both, also the presence/ absence of Cu or Ni) was confirmed. The thicknesses of the oxide coating were measured by taking the light field images of three fields of view, and the average thereof was determined as the "thickness of the oxide coating". The structure of the oxide coating was analyzed by using Si as a standard sample and by checking a lattice constant determined from a nano electron diffraction diagram with a value of JCPDS (Joint Committee for Powder Diffraction Standards) card (error less than 5%). In a nano electron diffraction image, a Debye-Scherrer ring (diffraction ring) is obtained from a polycrystalline structure, and a halo pattern is obtained from a non-crystalline structure. Accordingly, a sample in which a hallo pattern was confirmed was evaluated as including a non-crystalline structure (○), and a sample in which that was not confirmed was evaluated as x.

[Evaluation Corrosion Resistance]

Corrosion resistance was evaluated as follows. That is, a beaker test using a 1% $H_2SO_4$ aqueous solution was performed, in which a sample was immersed therein at room temperature for 24-36 hours (Hr) while the aqueous solution was being stirred. After the test, the appearance of the sample was observed and a corrosion weight loss thereof was measured. In the appearance observation after the test, the presence/absence of rust and the scale of rust, if any, were confirmed and measured, and a value (herein, referred to as a "rust area ratio") was calculated by the expression of 100×(rust area)/(surface area of a sample), so that a sample was determined as "○" when the rust area ratio was 0%; as "Δ" when the rust area ratio was more than 0% but less than 10%; and as "x" when the rust area ratio was no less than 10%. In the corrosion weight loss measurement, a corrosion weight loss was determined by a mass variation of a sample before and after the immersion was divided by the initial surface area of the sample and an immersion period of time. A steel material whose rust area ratio was determined as ○ and corrosion weight loss was no more than 1.0 g/($m^2$·Hr) was evaluated as "○" in the corrosion resistance column of Table 2, assuming that the steel material was excellent in corrosion resistance, namely, had greater corrosion resistance than electromagnetic stainless steel. On the other hand, a steel material that did not satisfy either of the two was evaluated as "x" in the corrosion resistance column of Table 2, assuming that the steel material was inferior in corrosion resistance. Herein, a big difference was not observed between the corrosion resistance evaluation results of the polished rod cut product and the cut test piece.

[Evaluation of Magnetic Properties]

Magnetic properties were evaluated according to JIS C2504 by producing a ring shaped specimen having a size of 18 mm in outer diameter×10 mm in inner diameter×3 mm in thickness from the rolled material having a diameter of 20 mm, the ring test piece then being subjected to annealing under the conditions shown in Table 2. The magnetization curve of a steel material with the excitation coil of 150 turns and the detection coil of 25 turns was drawn by using an automatic magnetization measuring device (BHS-40 made by Riken Denshi Co., Ltd.) at room temperature, so that the coercive force and the magnetic flux density under applied magnetic field of 400 A/m were determined. A steel sample whose coercive force was no more than 80 A/m and magnetic flux density was no less than 1.20 T was evaluated as "○" in the magnetic properties column of Table 2, assuming that the steel sample was excellent in magnetic properties, while a steel sample that did not satisfy either of the two was evaluated as "x" in the magnetic properties column of Table 2, assuming that the steel sample was inferior in magnetic properties.

These results are shown in Table 2.

TABLE 1

| Steel Material | Chemical composition (% by mass) with the remainder being iron and unavoidable impurities | | | | | | | | | | |
|---|---|---|---|---|---|---|---|---|---|---|---|
| No. | C | Si | Mn | P | S | Cr | Al | N | Cu | Ni | Pb |
| E01 | 0.012 | 2.00 | 0.36 | 0.005 | 0.003 | 1.50 | 0.003 | 0.0054 | — | 0.01 | — |
| E02 | 0.006 | 1.48 | 0.27 | 0.003 | 0.004 | 0.01 | 0.003 | 0.0021 | 0.01 | — | — |
| E03 | 0.007 | 1.97 | 0.33 | 0.003 | 0.005 | 0.01 | 0.004 | 0.0017 | — | — | — |
| E04 | 0.004 | 1.99 | 0.44 | 0.003 | 0.023 | 0.01 | 0.003 | 0.0022 | 0.01 | — | — |
| E05 | 0.006 | 1.98 | 0.22 | 0.003 | 0.086 | 0.01 | 0.004 | 0.0023 | — | — | — |
| E06 | 0.003 | 2.67 | 0.51 | 0.004 | 0.004 | 0.01 | 0.004 | 0.0019 | 0.01 | 0.01 | — |
| E07 | 0.003 | 3.50 | 0.15 | 0.004 | 0.003 | 0.01 | 0.004 | 0.0022 | — | — | — |
| E08 | 0.010 | 2.74 | 0.29 | 0.006 | 0.020 | 0.12 | 0.004 | 0.0040 | 0.01 | 0.03 | 0.08 |
| E09 | 0.005 | 2.03 | 0.63 | 0.003 | 0.027 | 0.01 | 0.004 | 0.0010 | 0.29 | 0.30 | — |
| E10 | 0.005 | 2.42 | 0.25 | 0.006 | 0.004 | 3.56 | 0.009 | 0.0011 | 0.01 | 0.10 | — |
| F01 | 0.005 | 6.03 | 0.23 | 0.004 | 0.003 | — | 0.005 | 0.0021 | 0.01 | 0.01 | — |
| F02 | 0.009 | 0.77 | 0.29 | 0.031 | 0.015 | 13.99 | 0.272 | 0.0078 | 0.10 | 0.19 | 0.17 |
| F03 | 0.007 | 2.98 | 0.32 | 0.011 | 0.006 | 7.16 | 0.004 | 0.0046 | — | — | — |
| F04 | 0.048 | 0.01 | 0.36 | 0.007 | 0.005 | 0.01 | 0.042 | 0.0042 | 0.01 | — | — |
| F05 | 0.108 | 0.18 | 0.48 | 0.013 | 0.015 | 0.08 | 0.024 | 0.0022 | 0.01 | 0.01 | — |
| F06 | 0.007 | 0.01 | 1.50 | 0.006 | 0.100 | 0.01 | 0.002 | 0.0030 | — | 0.01 | — |
| F07 | 0.015 | 0.05 | 0.22 | 0.007 | 0.010 | 2.50 | 0.002 | 0.0030 | 0.70 | 0.65 | — |
| F08 | 0.009 | 0.01 | 0.24 | 0.005 | 0.004 | 0.02 | 0.002 | 0.0028 | — | 0.02 | — |
| F09 | 0.006 | 0.51 | 0.25 | 0.005 | 0.003 | — | 0.006 | 0.0029 | — | — | — |

TABLE 2

| Experiment No. | Steel material No. | Annealing temperature [° C.] | Annealing time [time (Hr)] | Oxygen concentration (Vol ppm) in annealing atmosphere | Oxide film: Thickness [nm] | Oxide film: Included element | Oxide film: Presence/absence of non-crystalline layer | Corrosion resistance: Rust area ratio | Corrosion resistance: Corrosion weight loss [g/(m$^2$ · Hr)] | Corrosion resistance: Evaluation | Magnetic properties: Magnetic flux density [T] | Magnetic properties: Coercive force [Mm] | Magnetic properties: Evaluation |
|---|---|---|---|---|---|---|---|---|---|---|---|---|---|
| G01 | E01 | 850 | 10 | 0.3($H_2$) | 127 | Si, Cr | ○ | ○ | 0.75 | ○ | 1.47 | 33.2 | ○ |
| G02 | E02 | 950 | 3 | 0.3($H_2$) | 265 | Si | ○ | ○ | 0.60 | ○ | 1.52 | 22.3 | ○ |
| G03 | E03 | 850 | 10 | 0.3($H_2$) | 80 | Si | ○ | ○ | 0.50 | ○ | 1.50 | 19.5 | ○ |
| G04 | E04 | 850 | 10 | 0.3($H_2$) | 73 | Si | ○ | ○ | 0.80 | ○ | 1.49 | 28.5 | ○ |
| G05 | E05 | 900 | 3 | 0.3($H_2$) | 69 | Si | ○ | ○ | 0.60 | ○ | 1.46 | 37.6 | ○ |
| G06 | E05 | 1100 | 3 | 0.3($H_2$) | 321 | Si | ○ | ○ | 0.10 | ○ | 1.48 | 35.3 | ○ |
| G07 | E06 | 950 | 3 | 0.3($H_2$) | 67 | Si | ○ | ○ | 0.40 | ○ | 1.44 | 16.3 | ○ |
| G08 | E07 | 950 | 3 | 0.3($H_2$) | 120 | Si | ○ | ○ | 0.70 | ○ | 1.41 | 14.7 | ○ |
| G09 | E08 | 850 | 3 | 0.3($H_2$) | 100 | Si | ○ | ○ | 0.20 | ○ | 1.49 | 45.5 | ○ |
| G10 | E09 | 850 | 3 | 0.3($H_2$) | 98 | Si, Cu, Ni | ○ | ○ | 0.11 | ○ | 1.51 | 50.3 | ○ |
| G11 | E10 | 850 | 3 | 0.3($H_2$) | 183 | Si, Cr | ○ | ○ | 0.22 | ○ | 1.23 | 34.7 | ○ |
| H01 | F01 | 950 | 3 | 0.3($H_2$) | 534 | Si | x | x | 8.31 | x | 1.25 | 17.5 | ○ |
| H02 | F02 | 850 | 3 | 0.3($H_2$) | 1,000 | Cr, Si | x | ○ | 1.40 | x | 1.19 | 70.1 | x |
| H03 | F02 | 850 | 3 | 0.3($H_2$) | 0 ※ | — | — | ○ | 1.10 | x | 1.19 | 70.1 | x |
| H04 | F03 | 850 | 3 | 0.3($H_2$) | 163 | Cr, Si | x | Δ | 1.90 | x | 1.18 | 75.3 | x |
| H05 | E01 | 600 | 3 | 0.3($H_2$) | 2 | Si | x | x | 6.45 | x | 1.30 | 36.8 | ○ |
| H06 | F08 | 850 | 3 | 5.0(Ar) | 667 | — | x | x | 4.63 | x | 1.56 | 63.3 | ○ |
| H07 | E01 | 850 | 10 | 0.3($H_2$) | 0 ※ | — | — | x | 7.55 | x | 1.47 | 33.3 | ○ |
| H08 | F04 | 850 | 3 | 0.3($H_2$) | 13 | — | x | x | 6.25 | x | 1.12 | 85.9 | x |
| H09 | F05 | 850 | 3 | 0.3($H_2$) | 18 | — | x | x | 7.64 | x | 1.06 | 159.2 | x |
| H10 | F06 | 850 | 3 | 0.3($H_2$) | 44 | — | x | x | 4.17 | x | 1.10 | 123.0 | x |
| H11 | F07 | 900 | 3 | 0.3($H_2$) | 32 | Cr | x | x | 1.67 | x | 1.09 | 102.1 | x |
| H12 | F09 | 850 | 3 | 0.3($H_2$) | 51 | Si | x | x | 1.12 | x | 1.54 | 45.3 | ○ |
| H13 | E01 | 850 | 3 | Atmospheric air | 5,200 | Si, Cr | x | x | 4.93 | x | 1.36 | 50.8 | ○ |
| H14 | E01 | 1300 | 3 | 0.3($H_2$) | 2,000 | Si, Cr | x | x | 2.12 | x | 1.45 | 38.1 | ○ |

*After annealing, oxide coating was cut.

The following considerations can be made from Tables 1 and 2. In each of Experiments Nos. G01-G11 in Table 2, the chemical composition and the production method were both properly controlled, and hence each of them exhibited greater corrosion resistance than electromagnetic stainless steel and exhibited excellent magnetic properties.

On the other hand, in each of Experiments Nos. H01-H14, the chemical composition or the production method was not proper, and hence excellent corrosion resistance was not obtained, and in some instances the magnetic properties were further inferior. Details are as follows.

In Experiment No. H01, in particular, the amount of Si was excessive, and hence the thickness of the oxide coating formed in the annealing was out of the range of the present invention and further the oxide coating did not include a non-crystalline layer, thereby not allowing excellent corrosion resistance to be obtained.

In Experiment No. H02, in particular, the amount of Cr was excessive and the amount of Si was insufficient, and hence the thickness of the oxide coating formed in the annealing was greatly out of the specified upper limit and the oxide coating did not include a non-crystalline layer, thereby causing the corrosion resistance to be insufficient. Also, the magnetic properties were inferior.

Each of Experiments Nos. H03 and H07 represents an example in which the oxide coating on the steel material surface was removed by cutting, and because there was no oxide coating thereon, the corrosion resistance was insufficient. In Experiment No. H03, an excessive amount of Cr was included, and hence rust was not produced. Also in Experiment No. H03, the amount of Cr in the steel was excessive, and hence the magnetic properties were inferior.

In Experiment No. H04, the amount of Cr was excessive, and hence a non-crystalline layer was not formed in the oxide coating, thereby causing the corrosion resistance to be insufficient. Also, the magnetic properties were inferior.

In Experiment No. H05, the annealing temperature was too low, and hence the thickness of the oxide coating was out of the specified lower limit and the oxide coating did not include a non-crystalline layer, thereby not allowing excellent corrosion resistance to be obtained.

Experiment No. H06 represents an example in which annealing was performed in an Ar atmosphere having an oxygen concentration of 5.0 ppm by volume in a production step. In this example, the amount of Si in the steel material was insufficient and the oxygen concentration during the annealing was too high, and hence the thickness of the oxide coating exceeded the specified upper limit and a non-crystalline layer was not formed in the oxide coating, thereby causing the corrosion resistance to be insufficient.

In each of Experiments Nos. H08 and H09, in particular, the amount of C was excessive, and hence the magnetic properties were inferior, and because the amount of Si was insufficient, a non-crystalline layer was not formed in the oxide coating, thereby causing the corrosion resistance also to be inferior.

In Experiment No. H10, an excessive amount of Mn was included, and hence the magnetic properties were inferior. Further, because the amount of Si was insufficient, a non-crystalline layer was not formed in the oxide coating, thereby causing the corrosion resistance to be insufficient.

In Experiment No. H11, the amounts of Cu and Ni were excessive, and hence the magnetic properties were deteriorated. Further, because the amount of Si was insufficient, a non-crystalline layer was not formed in the oxide coating, thereby causing the corrosion resistance to be insufficient.

In Experiment No. H12, the amount of Si was insufficient, and hence a non-crystalline layer was not included in the oxide coating, thereby causing the corrosion resistance to be insufficient.

Experiment No. H13 represents an example in which annealing was performed in the air, and because the oxygen concentration during the annealing was too high, the thickness of the oxide coating greatly exceeded the specified upper limit and the oxide coating did not include a non-crystalline layer, thereby causing the corrosion resistance to be insufficient.

In Experiment No. H14, the annealing temperature was too high, and hence the thickness of the oxide coating exceeded the specified upper limit and the oxide coating did not include a non-crystalline layer, thereby causing the corrosion resistance to be insufficient.

INDUSTRIAL APPLICABILITY

The steel material according to the present invention has a soft magnetic property and is useful, for example, as the iron cores, the magnetic shield materials, and the actuator members for electromagnetic valves, solenoids, and relays, etc., to be used in various electromagnetic components targeting automobiles, electric trains, and ships, etc.

The steel material exerts excellent properties in an environment in which high corrosion resistance is particularly required.

The invention claimed is:

1. A steel material, consisting of:
from 0.001 mass % to 0.025 mass % of C;
from 1.8 mass % to 4.0 mass % of Si;
from 0.1 mass % to 1.0 mass % of Mn;
more than 0 mass % and 0.030 mass % or less of P;
more than 0 mass % and 0.10 mass % or less of S;
more than 0 mass % and 4.0 mass % or less of Cr;
more than 0 mass % and 0.010 mass % or less of Al; and
more than 0 mass % and 0.01mass % or less of N; and
optionally, at least one selected from the group consisting of:
more than 0 mass % and 0.5mass % or less of Cu;
more than 0 mass % and 0.5mass % or less of Ni; and
more than 0 mass % and 1.0 mass % or less of Pb;
with the remainder consisting of iron and unavoidable impurities,
wherein said steel material comprises an oxide coating on its surface, and
wherein the oxide coating comprises Si, Cr, or a combination thereof, includes a non-crystalline layer, and has a thickness of from 50 nm to 500 nm, and
wherein the steel material has a coercive force no more than 80 A/m and a magnetic flux density no less than 1.20 T, as determined by JIS C2504 on a ring shaped specimen of the steel material having a size of 18 mm in outer diameter×10 mm in inner diameter×3 mm in thickness.

2. A method for producing the steel material of claim 1, the method comprising:
producing a steel material consisting of:
from 0.001 mass % to 0.025 mass % of C;
from 1.8 mass % to 4.0 mass % of Si;
from 0.1 mass % to 1.0 mass % of Mn;
more than 0 mass % and 0.030 mass % or less of P;
more than 0 mass % and 0.10 mass % or less of S;
more than 0 mass % and 4.0 mass % or less of Cr;
more than 0 mass % and 0.010 mass % or less of Al; and
more than 0 mass % 0.01mass % or less of N; and
optionally, at least one selected from the group consisting of:
more than 0 mass % and 0.5mass % or less of Cu;
more than 0 mass % and 0.5mass % or less of Ni; and
more than 0 mass % and 1.0 mass % or less of Pb;
with the remainder consisting of iron and unavoidable impurities;
annealing the steel material, wherein the annealing comprises treating the steel material in an atmosphere containing 1.0 ppm or less of oxygen by volume at a temperature of from 800° C. to 1,200° C. for a time from 1 hour to 20 hours, and
cooling the annealed steel material after the annealing from the annealing temperature to 300° C. at an average cooling rate of no more than 200° C./hour.

3. The method according to claim 2, wherein the annealing temperature is from 800° C. to 1,100° C.

4. The method according to claim 2, wherein the annealing temperature is from 800° C. to 1,000° C.

5. The method according to claim 2, wherein the annealing time is 10 hours or less.

6. The steel material according to claim 2, wherein the average cooling rate is no more than 150° C./hour.

7. The steel material according to claim 2, wherein the average cooling rate is no more than 100° C./hour.

8. The steel material according to claim 1 which has a corrosion resistance characterized by a rust area ratio of less than 10% after immersion of a test piece of the steel material having size of 8 mm in diameter×8 mm in length in 1% $H_2SO_4$ stirred for from 24 to 36 hours at room temperature.

9. An iron core, magnetic shield material, or an actuator member for an electromagnetic valve, solenoid, relay or other electromagnetic component, comprising the steel material according to claim 1.

* * * * *